United States Patent [19]

Howell

[11] 3,961,376

[45] June 8, 1976

[54] DETACHABLE CONNECTION FOR COMBINATION SHORTS AND SKIRT

[76] Inventor: Evelyn M. Howell, 711 E. Jane St., Valdosta, Ga. 31601

[22] Filed: Mar. 6, 1975

[21] Appl. No.: 556,171

[52] U.S. Cl. ..... 2/71

[51] Int. Cl.[2] ..... A41D 1/14

[58] Field of Search ..... 2/70, 71, 72, 212, 213, 2/75

[56] References Cited

UNITED STATES PATENTS

| | | | |
|---|---|---|---|
| 1,068,976 | 7/1913 | Buckler | 2/75 |
| 3,002,193 | 10/1961 | Briskman | 2/72 |

FOREIGN PATENTS OR APPLICATIONS

| | | | |
|---|---|---|---|
| 1,096,151 | 12/1954 | France | 2/70 |
| 1,498,447 | 9/1967 | France | 2/70 |

*Primary Examiner*—H. Hampton Hunter
*Attorney, Agent, or Firm*—Clarence A. O'Brien; Harvey B. Jacobson

[57] ABSTRACT

A combination of apparel is provided including a body encircling garment having a waistline and a hip line disposed below the waistline as well as lower marginal portions spaced below the waistline. A body band extends at least substantially entirely about the garment and includes upper and lower marginal edge portions with the upper marginal edge portion thereof being attached to the exterior of the garment along the hip line thereof with at least substantially the entire length of the band, extending about the garment, disposed below the upper marginal portion of the band being free of attachment to the garment. A body encircling skirt portion including upper and lower marginal portions is provided and the upper marginal portion of the skirt portion is upwardly displaced beneath the lower marginal edge portion of the band between the latter and the opposing waistline of the garment and removably attached to the garment. In this manner, if the garment comprises a pair of shorts or a jump suit an attractive skirt portion may be readily attached to the lower portion of the garment for covering the latter and readily removed therefrom whenever desired.

3 Claims, 4 Drawing Figures

DETACHABLE CONNECTION FOR COMBINATION SHORTS AND SKIRT

BACKGROUND OF THE INVENTION

Various shorts type garments including a skirt which may be removably attached thereto in order to convert the garment from a shorts type to a skirt type have been heretofore provided. However, the combination garment of the instant invention is specifically designed to achieve a more stylish appearance than similar types of combination garments heretofore provided.

Examples of previously patented combination type garments are disclosed in U.S. Pat. Nos. 1,784,369, 2,521,020, 2,899,962 and 3,002,193.

SUMMARY OF THE INVENTION

The combination garment of the instant invention is constructed in a manner whereby a shorts type garment or a jump suit type of garment may be readily transformed into a dress type garment in a manner of seconds. Furthermore, the combination garment of the instant invention is constructed in a manner whereby it will afford a stylish appearance.

The main object of this invention is to provide a combination garment which may be readily transformed from one type of garment to a second type of garment.

Another object of this invention, in accordance with the immediately preceding object, is to provide simple structure whereby an existing single type of garment may be readily transformed into a combination type of garment in accordance with the present invention.

Another important object of this invention is to provide a combination garment which will afford an attractive appearance.

A final object of this invention to be specifically enumerated herein is to provide an apparatus which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
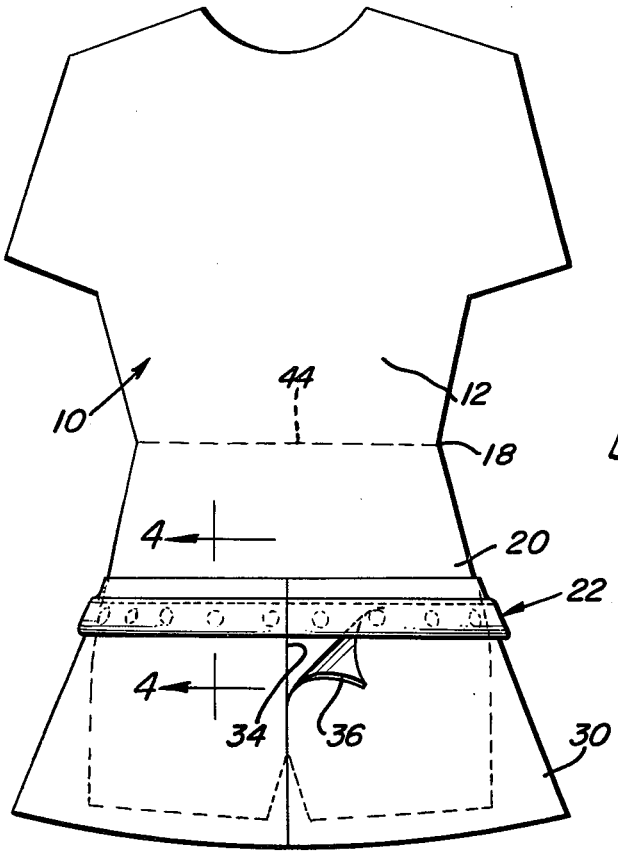
FIG. 1 is a front elevational view of a jump suit type of garment which has been transformed into a combination type garment in accordance with the present invention including a removable skirt portion.
Figure 2:
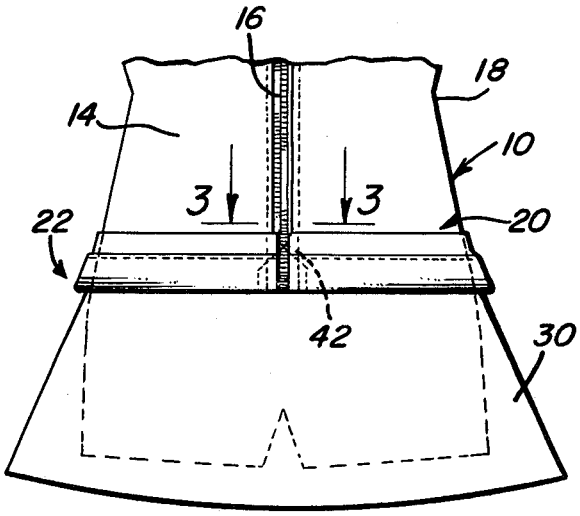
FIG. 2 is a fragmentary rear elevational view of the lower portion of the assemblage illustrated in FIG. 1.

Referring now more specifically to the drawings, the numeral 10 generally designates a conventional form of jump suit type of garment of substantially conventional design. The garment 10 includes a front side 12 and a rear side 14 equipped with a vertically extending slide fastener 16. The garment 10 includes a waistline 18 and a hip line 20.

In order to practice the present invention, a body band referred to in general by the reference numeral 22 is provided and folded along its longitudinal centerline. The band 22 is disposed about the garment 10 with the folded marginal edge portion 24 of the band 22 uppermost and the lower marginal edge portion of the folded band 22 disposed at the elevation of the hip line 20. Then, the lower marginal edge portion of the band 22 is sewn as at 26 to the hip line of the garment 10 and the folded marginal edge portion 24 of the band 22 is then swung outwardly and downwardly to the position thereof illustrated in FIG. 4 and the band 22 is further top stitched as at 28.

Figure 3:
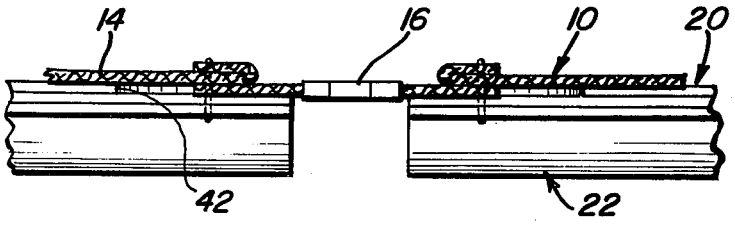
FIG. 3 is an enlarged fragmentary horizontal sectional view taken substantially upon the plane indicated by the section line 3—3 of FIG. 2.

The opposite ends of the band 22 are beveled downwardly and are sewn in with the lower end of the slide fastener 16 to the garment 10 with the ends of the band 22 slightly spaced apart and disposed on opposite sides of the slide fastener 16, see FIG. 3.

Figure 4:
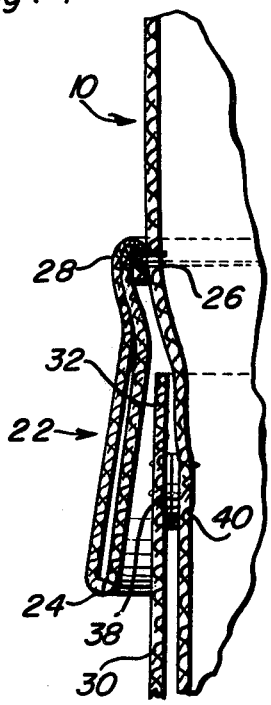
FIG. 4 is an enlarged fragmentary vertical sectional view taken substantially upon the plane indicated by the section line 4—4 of FIG. 1.

A body encircling skirt portion 30 is provided and includes an upper marginal edge portion 32 upwardly displaced behind the band 22 in the manner illustrated in FIG. 4 of the drawings. The body encircling skirt portion 30 includes opposite ends 34 and 36 which are disposed in edge-to-edge abutting relation and corresponding longitudinally spaced inner surfaces of the upper marginal edge portion 32 of the body encircling skirt portion 30 and the opposing outer surface portions of the hip line of the garment 10 include coacting readily releasably engaged male and female snap fastener elements 38 and 40 secured thereto in any convenient manner such as by stitching. Accordingly, the body encircling skirt portion 30 is removably supported from that portion of the hip line 20 of the garment 10 disposed beneath the band 22.

The upper marginal edge portion 32 of the body encircling skirt portion 30 includes an upwardly opening notch 42 centrally intermediate its opposite ends in which the end portions of the band 22 sewn to the garment 10 on opposite sides of the lower end of the slide fastener 16 are received. It will of course be noted that the lower marginal edge of the skirt portion 30 projects below the lower marginal portions of the garment 10. Further, any suitable means such as Velcro strips or adhesive strips may be utilized in lieu of the snap fasteners 38 and 40. Still further, the body encircling skirt portion 30 could be constructed so as to be continuous although such construction would require that the skirt portion be either stepped into or pulled downwardly over the head of the user when the skirt portion is applied to the garment 10.

The material of which the band 22 is formed may be cut on a bias and the invention may be utilized in conjunction with a garment which is not provided with a slide fastener. In such case, the opposite ends of the band 22 may be sewn together and the band 22 may be attached to the associated garment merely by means of the stitching 26 and 28. Further, if the invention is to be utilized on a garment which is not equipped with a slide fastener corresponding to the fastener 16, the upper marginal edge portion 32 of the body encircling skirt portion 30 need not include the upwardly opening recess 42 and the garment 10 may be in the form of a pair of shorts, in which case the upper marginal edge portion of the garment 10 will extend along the waistline 18 as at 44, see FIG. 1 and be equipped with a suitable waistband.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a body encircling garment including a waistline and a hip line disposed below the waistline as well as short legs extending downwardly below said hip line, said garment further including front and rear sides and vertical central rear side slide fastener means releasably connecting separable upper opposite side portions of said rear side, said slide fastener means extending downwardly to a point spaced sightly below said hip line and above said legs, a body band including opposite ends and extending at least substantially entirely about said garment and including upper and lower marginal edge portions, said upper marginal edge portion of said band being attached to the exterior of said garment along the hip line thereof with at least substantially the entire length of said band, extending about said garment, disposed below said upper marginal portion being free of attachment to said garment, the opposite end edge portions of said band being attached to said garment along and at opposite sides of the lower end of said slide fastener means, a body encircling skirt portion including upper and lower marginal portions, said upper marginal portion of said skirt portion being upwardly displaced beneath the lower marginal edge portion of said band between the latter and the opposing hip line of said garment, said skirt upper marginal portion and the hip line of said garment including coacting means removably attaching said skirt portion to said garment, said skirt portion comprising a horizontally elongated panel member having opposite ends, said panel member extending about the portion of said garment disposed below said hip line with the ends of said panel member disposed in at least closely adjacent relation and overlying the center of the front side of said garment, said panel member including a lower marginal portion projecting downwardly beyond the lower marginal portions of the short legs of said garment and an upper marginal edge portion having an upwardly opening notch formed therein centrally intermediate the opposite ends of said panel member, the width of said notch extending along said panel member, being greater than the spacing between said opposite end portions of said band attached to said garment, that portion of the panel member defining the bottom of said notch bridging and passing between and below, respectively, the opposite ends of said panel member and the upper marginal portions of said panel member defining the ends of said notch, spaced along said panel member, being received beneath the end portions of said band closely adjacent said end edge portions of said band secured to said garment.

2. The combination of claim 1 wherein said garment comprises a jump suit with short legs.

3. The combination of claim 1 wherein said garment comprises a pair of shorts.

* * * * *